United States Patent [19]

Lebrecht

[11] Patent Number: 5,044,180

[45] Date of Patent: Sep. 3, 1991

[54] REKEYABLE SHROUDED LOCK

[75] Inventor: Horst Lebrecht, Reedsburg, Wis.

[73] Assignee: Master Lock Company, Milwaukee, Wis.

[21] Appl. No.: 529,059

[22] Filed: May 25, 1990

[51] Int. Cl.[5] ..... E05B 67/02; E05B 67/28

[52] U.S. Cl. ..... 70/48; 70/52

[58] Field of Search ..... 70/52, 54, 55, 56, 48, 70/41, 45, 46, 47, 27, 28, 29

[56] References Cited

U.S. PATENT DOCUMENTS

| | | | |
|---|---|---|---|
| 1,520,975 | 12/1924 | Sterling | 70/52 |
| 2,136,654 | 11/1938 | North | 70/52 |
| 2,865,193 | 12/1958 | McConnell . | |
| 3,453,846 | 7/1969 | Owen et al. . | |
| 4,138,868 | 2/1979 | Richards, Sr. . | |
| 4,180,996 | 1/1980 | Lebrecht . | |
| 4,241,594 | 12/1980 | Miller et al. . | |
| 4,290,279 | 9/1981 | Fish et al. . | |
| 4,545,223 | 10/1985 | Poutiainen et al. . | |

FOREIGN PATENT DOCUMENTS

| | | | |
|---|---|---|---|
| 448981 | 6/1936 | United Kingdom | 70/48 |

*Primary Examiner*—Robert L. Wolfe

*Attorney, Agent, or Firm*—Pennie & Edmonds

[57] ABSTRACT

A shrouded shackle lock having two shell halves with a cover plate in one shell half and a hole in the opposite other shell half. Fastener means positioned in the lock are turnable by a wrench inserted in the hole in the other shell half for removing the cover when the fastener means is disengaged from the cover. Upon the removal of the cover the lock cylinder is removable for rekeying or substitution. The lock shell halves are engaged together using a lock retainer ring welded to one shell half and thereafter bent over and around the other shell half.

9 Claims, 4 Drawing Sheets

REKEYABLE SHROUDED LOCK

BACKGROUND OF THE INVENTION

Shrouded shackle locks with curved shackles are old. Locks rekeyable by replacement of the lock cylinders or parts therein when the locks are in their open position have earlier been proposed (U.S. Pat. Nos. 4,290,279; and 4,138,868). Locks in which tools can be inserted only when the lock is unlocked are also known (U.S. Pat. No. 3,977,221).

SUMMARY OF THE INVENTION

Broadly, the present invention is a shrouded shackle lock having a readily removable retainer cover attached to the housing through contained fasteners. Insertion of a tool for removal of such fasteners is prevented by a rotatable blocking cam plate unless the lock is in its open position.

It is a feature that the fasteners are retained in the lock ready for reattachment during retainer cover removal and replacement.

DESCRIPTION OF THE PREFERRED EMBODIMENT

Figure 1:
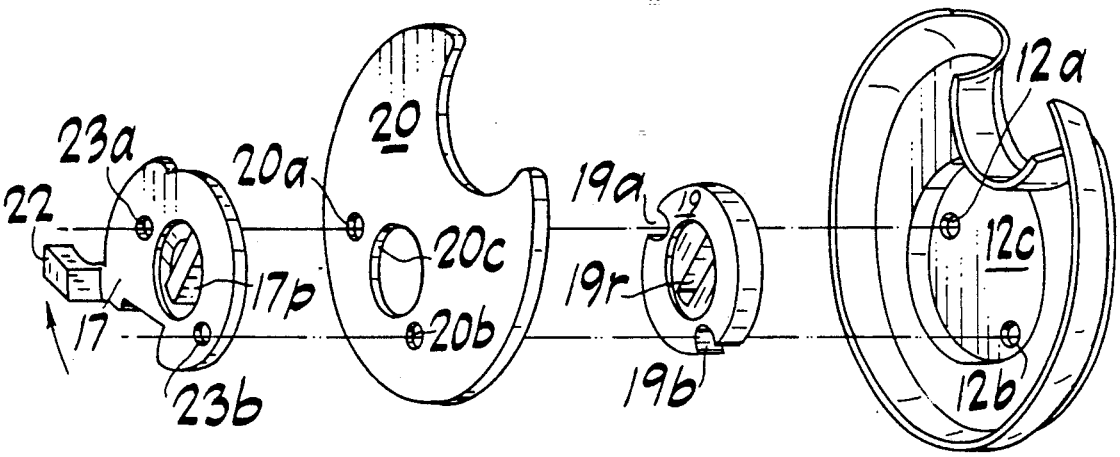
FIG. 1 is an exploded perspective view of selected lock parts.
Figure 2:
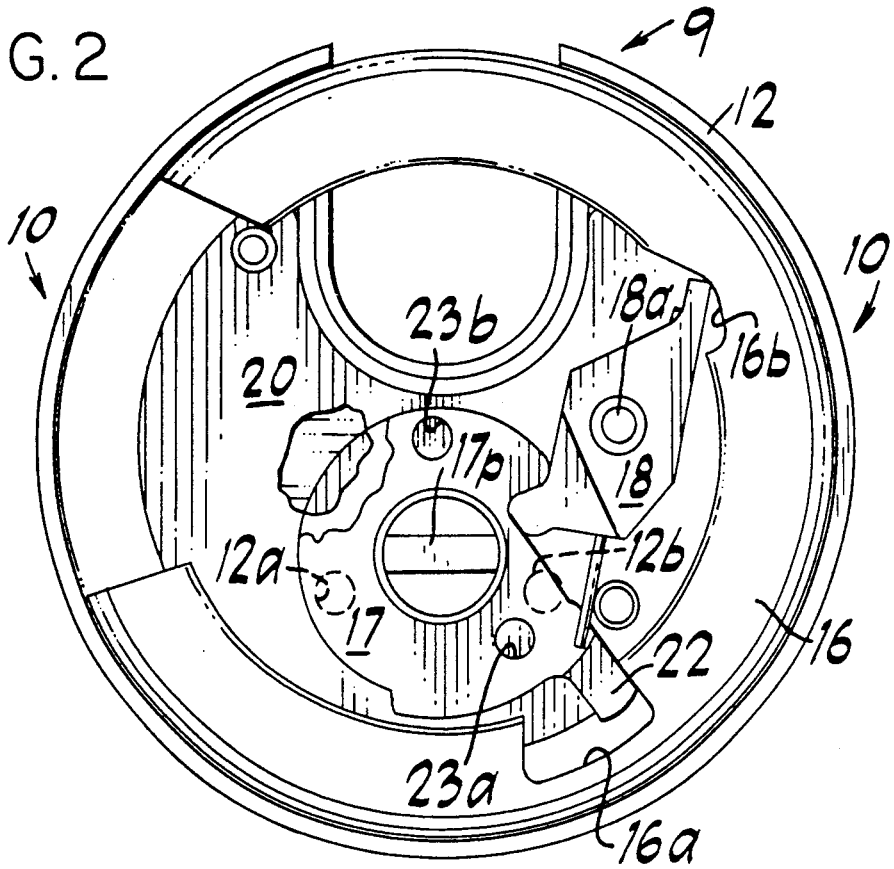
FIG. 2 is a sectional elevational view of the inventive shrouded shackle lock in its lock position.
Figure 3:
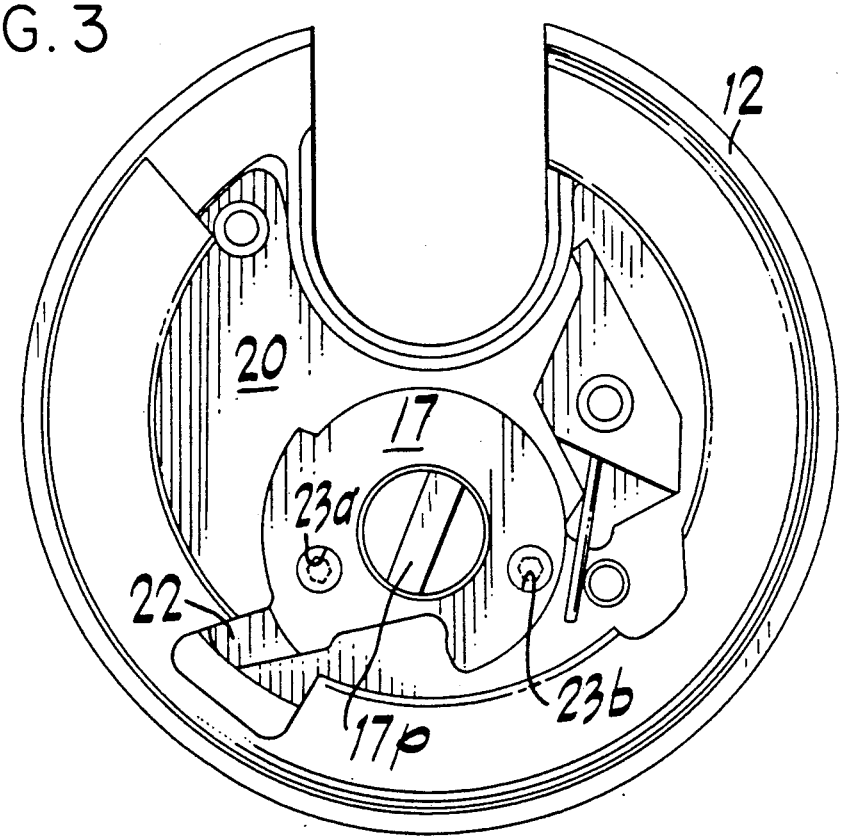
FIG. 3 is a sectional elevational view in the open position.
Figure 4:
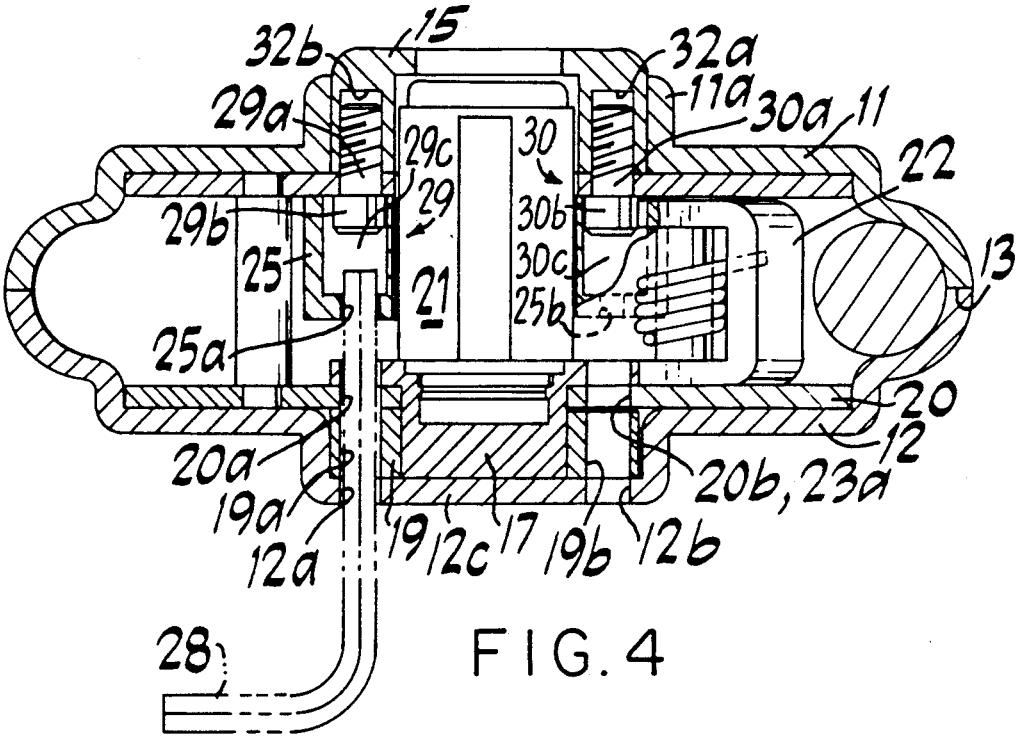
FIG. 4 is a cross-sectional view of the lock in the unlock position with a tool wrench inserted.

In FIGS. 1-5, lock 9 includes round casing 10 having front casing half 11 and back casing half 12 (FIG. 3). Casing half 11 includes cowling 11*a* for receiving retainer cover 15 within cowling 11*a* (FIG. 4). Casing halves 11, 12 are adjoined along line 13 (FIG. 4). Back casing half 12 includes a blister 12*c* with two spaced apart holes 12*a*, 12*b*. Within case 12 is curved shackle 16 having drive notch 16*a* and lock notch 16*b*, shackle drive cam 17 and lock latch 18 pivotal about pin 18*a* (FIG. 2). Also shown is stationary rear plate 20. Drive cam 17 has projection 17*p* which rotates in plate opening 20*c* and engages block cam recess 19*r*.

Figure 5:
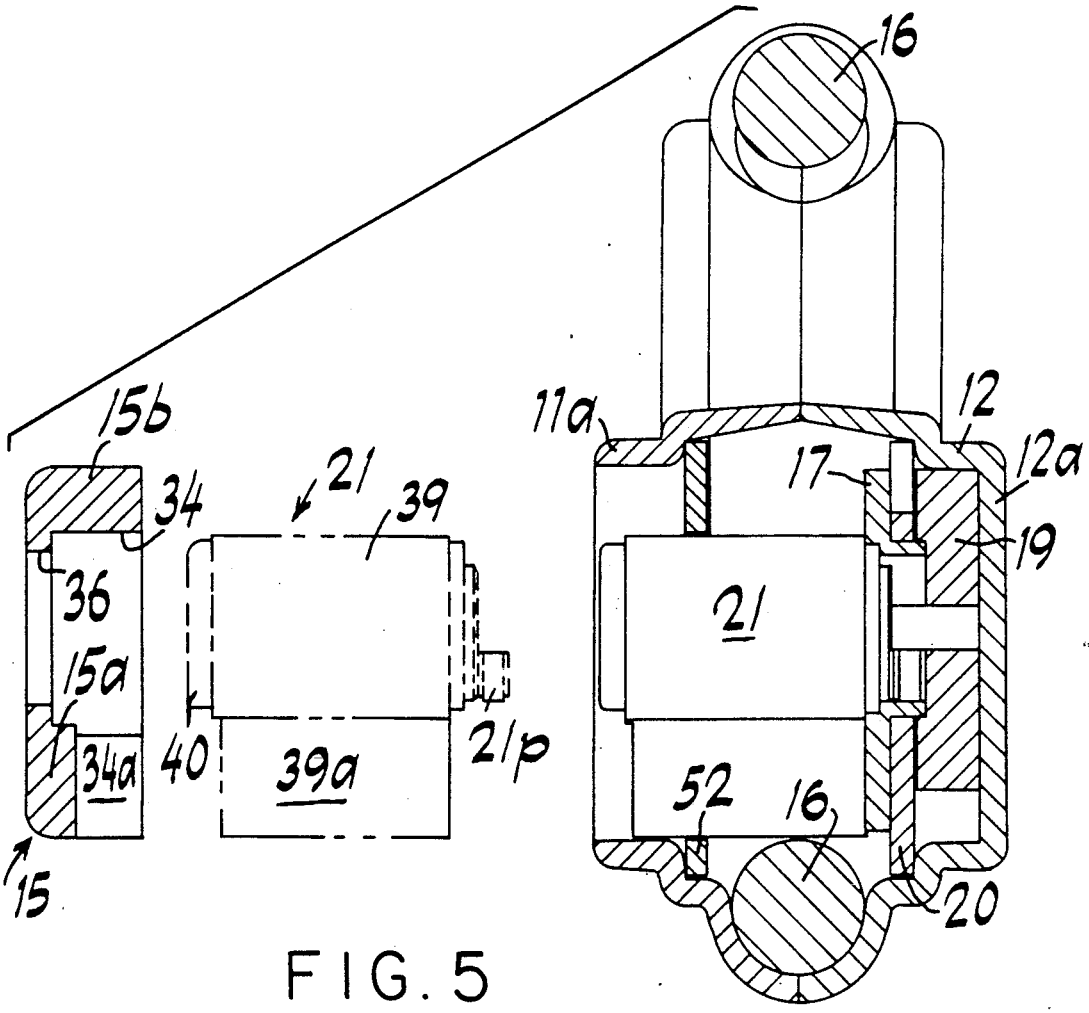
FIG. 5 is an exploded sectional view with the lock cover removed and lock cylinder shown both installed and removed.

Drive cam 17 including its projection 17*p* is connected to key cylinder prong 21*p* for rotation by cylinder plug 40 from open to closed positions (FIG. 5). Drive cam 17, rotatable about hole 20*c* in plate 20, includes shackle drive prong 22 and two spaced-apart holes 23*a*, 23*b* located to align with holes 12*a*, 12*b* when drive cam 17 is in the open position (FIGS. 1-3). Blocking cam 19 which is preferably made of hardened sheet to resist drilling carries notches 19*a*, 19*b*. Finally, internal frame piece 25 has two spaced-apart holes 25*a*, 25*b* (FIG. 4). Thus, when the following holes or notches are aligned:

1) hole 12*a* of casing half 12; notch 19*a* of blocking cam 19; 20*a* of stationary rear plate 20; 23*a* of drive cam 17 and hole 25*a* of frame 25, then and only then can wrench tool 28 be insertable to reach and turn bolt 29; and
2) hole 12*b* of casing half 12; 19*b* of blocking cam 19; 20*b* of rear plate 20, 23*b* of drive cam 17 and hole 25*b* of frame 25, then and only then can wrench tool 28 be insertable to reach and turn bolt 30.

Bolts 29, 30 are threadable into holes 32*a*, 32*b* of retainer cover 15. Bolt 29 has stem 29*a*, head 29*b* and is restrained in cavity 29*c* as it is fully unscrewed out of cover hole 32*b*. Cavity 29*c* is shaped and sized so that bolt 29 remains oriented therein to receive wrench 28 for turning when cover 15 is reattached. Head 29*b* has a depression in it (not shown) to receive wrench 28. As captured and restrained in cavity 29*c*, bolt 29 can be screwed back into hole 32*b* by manipulating wrench 28. Similarly, bolt 30 has stem 30*a*, head 30*b* and cavity 30*c*.

Turning to FIG. 5, retainer cover 15 includes external end portion 15*a*, side skirt portion 15*b* sized for positioning within cowling 11*a*. Lock-receiving recess 34 including tail recess portion 34*a* and key accommodating opening 36. Lock cylinder 21 includes housing 39 with tail 39*a*. Rekeyable plug 40 is rotatable within housing 39. Lock cylinder 21 is removable for rekeying or replacement as described.

Figure 6:
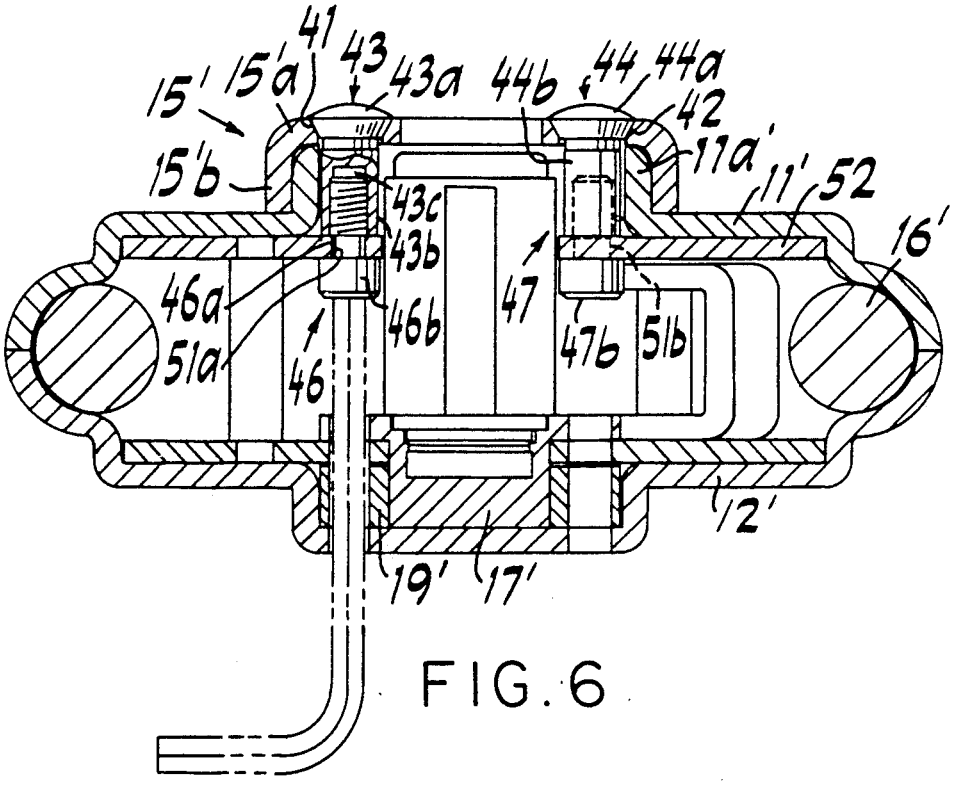
FIG. 6 is a cross-sectional view of an alternative embodiment of the invention in unlocked position.
Figure 6A:
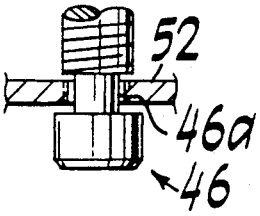
FIG. 6*a* is an enlarged partial view of FIG. 6 showing undercut bolt captured in a stationary plate.
Figure 7:
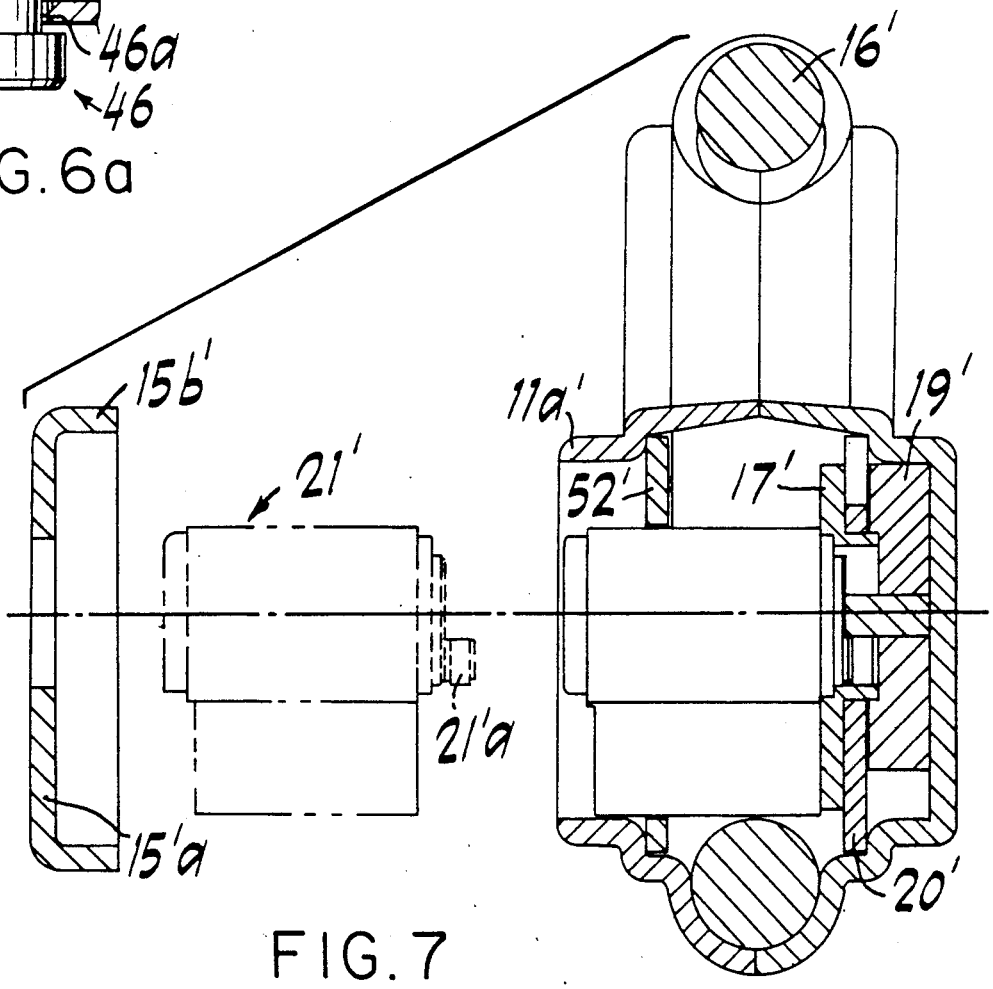
FIG. 7 is an exploded sectional view of the second embodiment.

Turning now to FIGS. 6, 6*a* and 7, an alternative embodiment is shown in which retainer cover 15' has face piece 15*a'* and side skirt 15*b'*. Retainer cover 15' is shaped to be positioned with its skirt 15*b'* on the outside of the cowling 11*a'*. Cover 15' includes two spaced-apart beveled holes 41, 42 for receiving fasteners 43, 44 respectively. Fastener 43 includes beveled head 43*a*, stem 43*b* and threaded recess 43*c* in stem 43*b* for receiving a bolt 46. Similarly, fastener 44 has beveled head 44*a*, stem 44*b* and recess 44*c* (not shown) for receiving bolt 47. Bolts 46 and 47 with heads 46*b*, 47*b* include undercuts 46*a*, 47*a* (not shown) which retain bolts 46, 47 in holes 51*a*, 51*b* of front plate 52 (see FIG. 6*a*). Bolts 46, 47 as mounted on plate 52 are free to spin but are otherwise captured by plate 52. When cover 15' is removed bolts 46 and 47 remain captured by plate 52. Other elements corresponding to the first embodiment are front casing 11', back casing 12'; shackle 16', drive cam 17', blocking cam 19', lock cylinder 21' and so forth.

Figure 8:
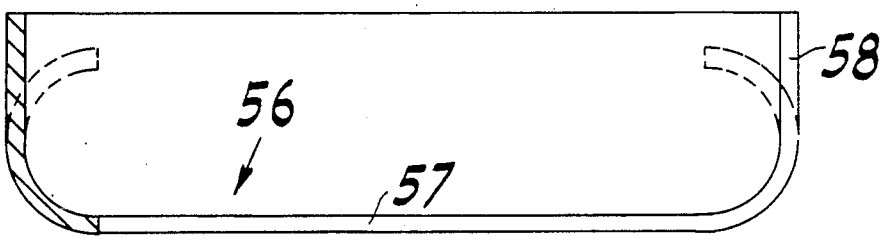
FIG. 8 is a side elevational view of a lock retainer ring.
Figure 9:
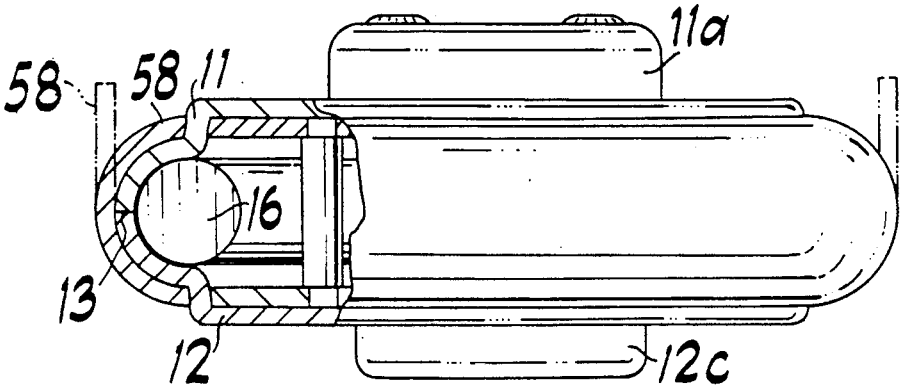
FIG. 9 is a side elevational view showing the retainer ring being installed and bent.

In FIGS. 8 and 9, there is the preferred arrangement for securing casing halves 11 and 12 together includes use of a lock retainer ring 56 having circular base piece 57 and bendable generally circular curved side piece 58. To accomplish assembly, back casing half 12 is placed in ring 56 and spot welded to ring 56. Front casing 11 is then placed on top of casing half 12 and side piece 58 is bent from its vertical position shown in dashed lines (FIG. 9) to its curled position (shown in solid lines in FIG. 9) to secure the halves 11 and 12 together. This construction improves good security of the lock.

I claim:

1. In a shrouded shackle lock having a shell with a front half portion and a rear half portion, a curved shackle, a lock cylinder, and a mechanism connecting the lock cylinder to the shackle, the improvement comprising an opening in the rear half shell portion;

a removable cover plate shaped to cover a second opening in the front half portion;

fastener means for fastening such cover plate to the shell and aligned to permit a wrench tool to be inserted into the rear half shell opening to engage the said fastener means;

a fastener means holding means within the shell for capturing and holding the fastener means when the cover has been disengaged from the fastener means; and rotatable blocking means positioned in the shell to block insertion of the wrench into fastener means when the lock is in its closed position.

2. The shrouded shackle lock of claim 1 in which the front shell includes cowling means around the opening and in which the cover plate is positionable within the cowling means.

3. The shrouded shackle lock of claim 1 in which the front shell including cowling means around the opening and in which the cover plate is positionable outside the cowling means.

4. The shrouded shackle lock of claim 1 in which the fastener means holding means includes a hole in a stationary plate and an undercut in the fastener means with plate hole and undercut so sized and shaped to permit the fastener means to rotate in the hole but not be removed therefrom.

5. The shrouded shackle lock of claim 1 in which the fastener means holding means is a cavity sized so that the fastener means remains positioned and oriented when the cover is unfastened so that the wrench can reengage the fastener means for subsequently securing the cover to the shell.

6. A method of engaging two generally circular first and second shell halves of a shrouded shackle lock comprising placing the first shell half in a lock retainer ring including a curved side piece;

attaching such first shell half to the ring;

placing the second shell half on the first shell half; and bending the curved side piece of such ring over the second shell half to hold the first and second shell halves together.

7. The method of claim 6 in which the attaching is performed by welding.

8. A shrouded shackle lock having first and second shell halves secured together within a lock retainer ring having base means attached to the first half and having a curved side piece bent over and around the second half.

9. In a shrouded shackle lock having a shell with a front half portion and a rear half portion, a curved shackle, a lock cylinder, and a mechanism connecting the lock cylinder to the shackle, the improvement comprising an opening in the rear half shell portion;

a removable cover plate shaped to cover a second opening in the front half portion through which second opening the lock cylinder can pass when the cover plate is removed;

fastener means for fastening such cover plate to the shell and aligned to permit a wrench tool to be inserted into the rear half shell opening to engage the said fastener means; and rotatable blocking means positioned in the shell to block insertion of the wrench into fastener means when the lock is in its closed position.

* * * * *